US009648957B2

(12) United States Patent
Su

(10) Patent No.: US 9,648,957 B2
(45) Date of Patent: May 16, 2017

(54) CHAIR WITH BACK TILT ADJUSTMENT STRUCTURE

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 65 days.

(21) Appl. No.: 14/818,425

(22) Filed: Aug. 5, 2015

(65) Prior Publication Data

US 2017/0035204 A1 Feb. 9, 2017

(51) Int. Cl.

| | |
|---|---|
| ***A47C 1/024*** | (2006.01) |
| ***A47C 1/038*** | (2006.01) |
| ***A47C 3/00*** | (2006.01) |
| ***B60N 2/02*** | (2006.01) |
| ***A47C 7/44*** | (2006.01) |
| ***A47C 1/032*** | (2006.01) |
| *A47C 7/40* | (2006.01) |
| *A47C 3/20* | (2006.01) |
| *A47C 7/00* | (2006.01) |

(52) U.S. Cl.

CPC ..... *A47C 7/44* (2013.01); *A47C 1/032* (2013.01); *A47C 3/20* (2013.01); *A47C 7/00* (2013.01); *A47C 7/40* (2013.01)

(58) Field of Classification Search

CPC ..... A47C 7/44; A47C 1/032; A47C 7/007; A47C 7/40; A47C 3/20; A47C 7/00

USPC ..... 297/301.1, 302.5, 302.6, 302.7, 325, 297/300.1, 337, 316, 452.18

See application file for complete search history.

(56) References Cited

U.S. PATENT DOCUMENTS

| | | | | | |
|---|---|---|---|---|---|
| 4,537,445 | A * | 8/1985 | Neuhoff | A47C 1/03255 | 297/300.3 |
| 5,318,345 | A * | 6/1994 | Olson | A47C 1/03255 | 297/300.5 |
| 5,810,439 | A * | 9/1998 | Roslund, Jr. | A47C 1/03238 | 297/300.2 |
| 5,909,923 | A * | 6/1999 | DeKraker | A47C 1/023 | 297/285 |
| 6,086,153 | A * | 7/2000 | Heidmann | A47C 1/023 | 297/300.1 |
| 6,139,103 | A * | 10/2000 | Hybarger | A47C 1/03238 | 297/300.2 |
| 6,250,715 | B1 * | 6/2001 | Caruso | A47C 1/03 | 297/300.2 |
| 6,669,292 | B2 * | 12/2003 | Koepke | A47C 1/03255 | 297/300.1 |
| 7,441,839 | B2 * | 10/2008 | Pennington | A47C 1/023 | 297/316 |
| 2005/0082889 | A1 * | 4/2005 | Tsai | A47C 1/022 | 297/337 |

(Continued)

*Primary Examiner* — Chi Q Nguyen

(57) ABSTRACT

The chair includes a cushion having a chassis, a back and an adjustment structure connected to the chassis. The adjustment structure includes a base frame and a back frame. The base frame has a main body with a connecting arm rotatably connecting the chassis. The back frame is connected between the back and the base frame and has a connecting portion connected to the base frame and a support substantially perpendicularly extending from the connecting portion toward the back. An arc-shaped bend portion is formed between the support and the connecting portion. A top of the support is connected to the back.

5 Claims, 7 Drawing Sheets

(56) References Cited

U.S. PATENT DOCUMENTS

| | | | | |
|---|---|---|---|---|
| 2007/0108821 | A1* | 5/2007 | Ueda | A47C 1/03255 297/301.1 |
| 2008/0309135 | A1* | 12/2008 | Machael | A47C 1/03255 297/301.4 |

* cited by examiner

CHAIR WITH BACK TILT ADJUSTMENT STRUCTURE

BACKGROUND OF THE INVENTION

1. Technical Field

The invention relates to chairs, particularly to chair backs.

2. Related Art

Office chairs with a cushion elevation mechanism and/or flexibly tiltable back have been very popular. A flexibly tiltable back is a very important mechanism because it makes users very comfortable. FIG. 1 shows a typical mechanism of flexibly tiltable back. Many chairs are provided with a flexible back with tilt flexibility, as shown in FIG. 1, they use a rotation mechanism 1 to make the back 11 tiltable. However, the tilting angle of the back 11 is limited the rotary angle range of the support arm 13 connected to the cushion 12. In other words, the back 11 cannot offer a larger angle range of tilting because it moves with the support arm 13 only. This limits comfort of users when they sit on the chair.

SUMMARY OF THE INVENTION

An object of the invention is to provide a chair with a back tilt adjustment structure, which can offer two-sectioned tilt adjustment to a chair back.

To accomplish the above object, the chair of the invention includes a cushion having a chassis, a back and an adjustment structure connected to the chassis. The adjustment structure includes a base frame and a back frame. The base frame has a main body with a connecting arm rotatably connecting the chassis. The back frame is connected between the back and the base frame and has a connecting portion connected to the base frame and a support substantially perpendicularly extending from the connecting portion toward the back. An arc-shaped bend portion is formed between the support and the connecting portion. A top of the support is connected to the back.

DETAILED DESCRIPTION OF THE INVENTION

Figure 1:
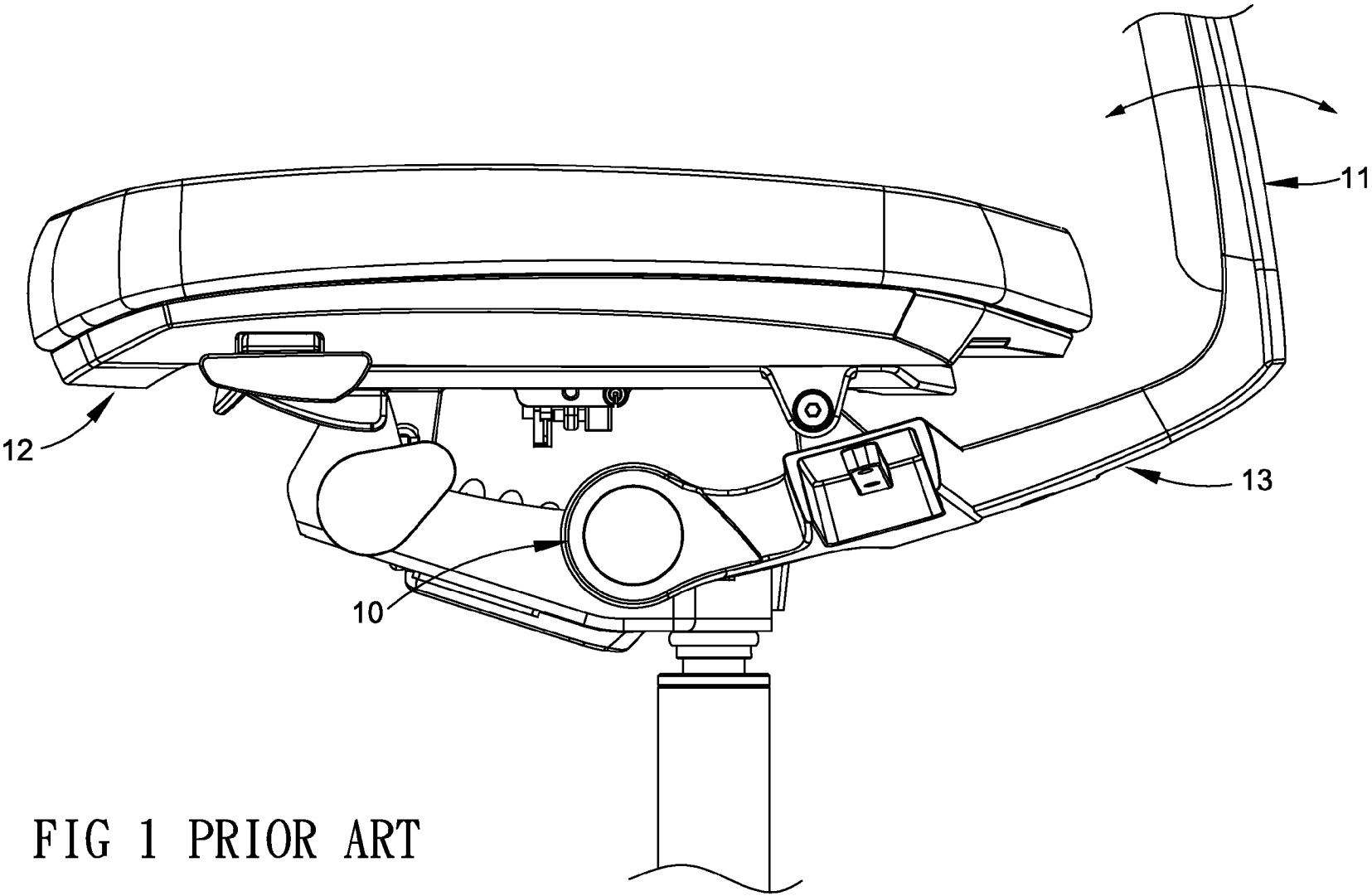
FIG 1 PRIOR ART
FIG. 1 is a schematic view of a conventional chair with a tiltable back.
Figure 2:
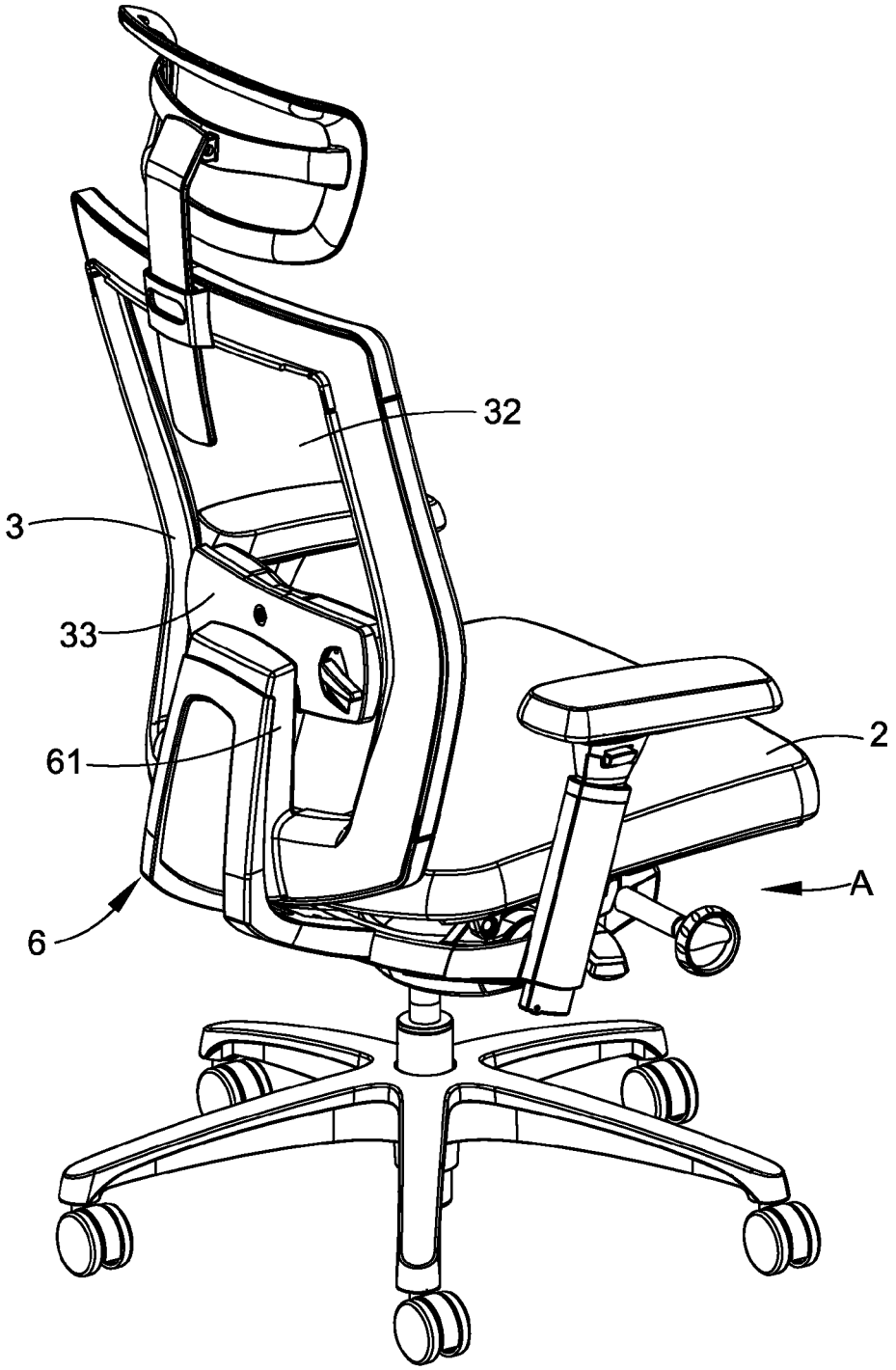
FIG. 2 is a perspective view of the invention.
Figure 3:
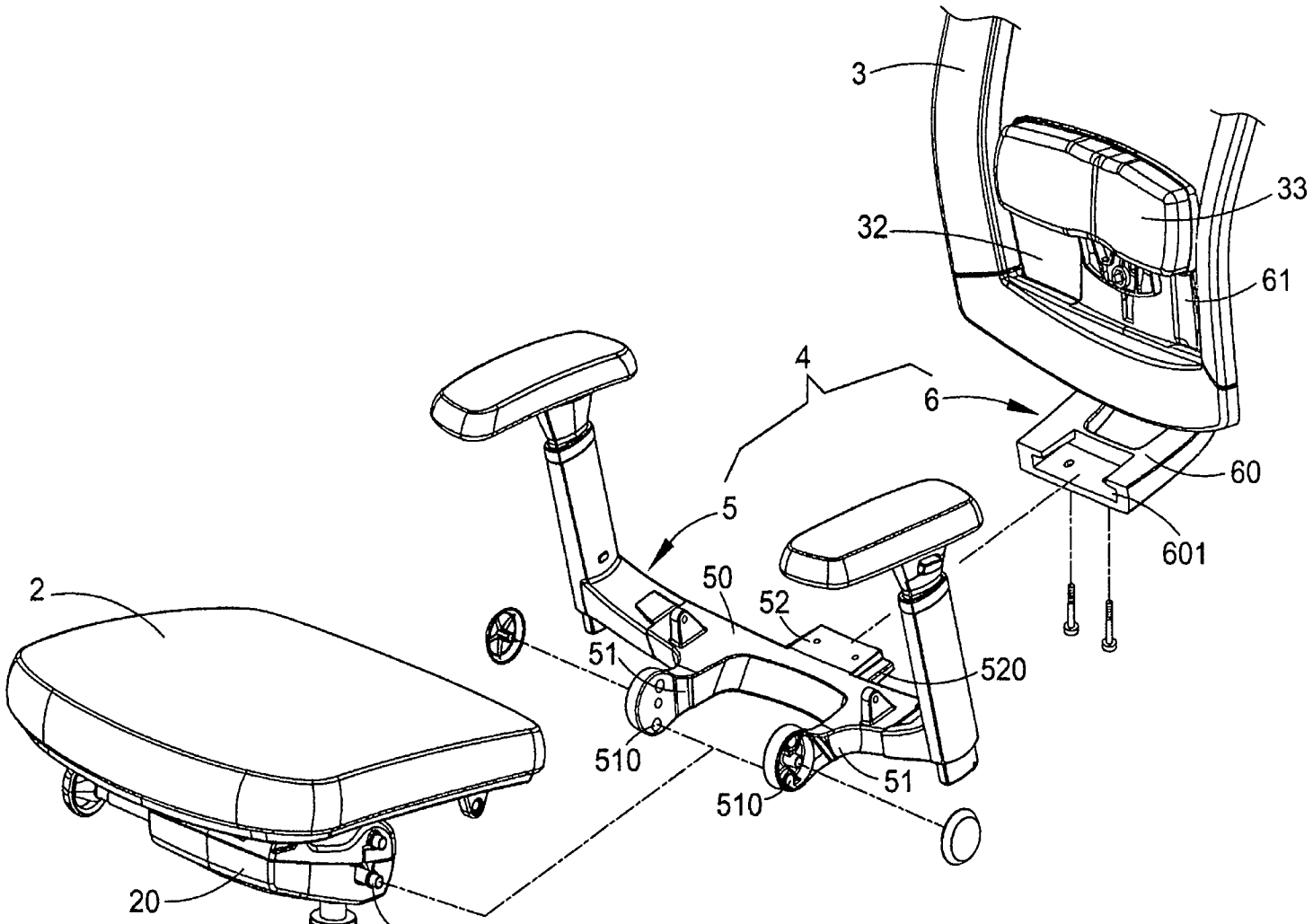
FIG. 3 is an exploded view of primary components of the invention.
Figure 4:
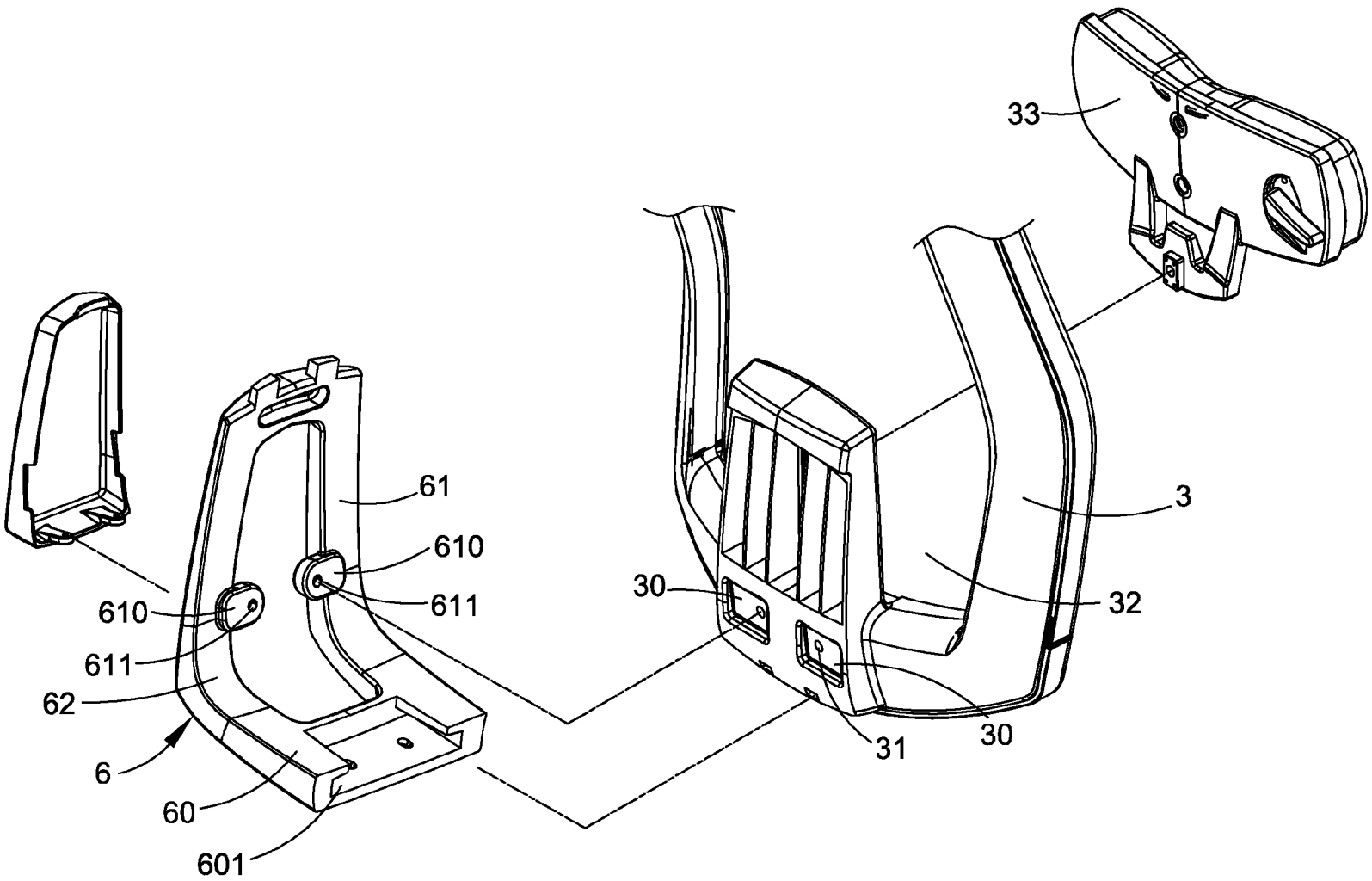
FIG. 4 is an exploded view of the back of the invention.

Please refer to FIGS. 2-4. The chair of the invention includes a cushion 2, a back 3 and an adjustment structure 4. The bottom of the cushion 2 is fixed with a chassis 20. The adjustment structure 4 includes a base frame 5 connected to the chassis 20 and a back frame 6 connected between the back 3 and the base frame 5.

The base frame 5 has a main body 50 with a connecting arm 51 rotatably connecting the chassis 20 as shown in FIG. 2. Please refer to FIG. 3, the chassis 20 is provided with a shaft 201. The connecting arm 51 is formed with a shaft hole 501 for receiving the shaft 201. Thus the connecting arm 51 can rotate about the shaft 201. An elasticity mechanism disposed in the chassis 20 can control the torque of the connecting arm 51. Additionally, the main body 50 is further formed with a connecting section 52 opposite to the connecting arm 51 in direction. The connecting section 52 is formed with two rails 520 for connecting the back frame 6.

Please refer to FIG. 3. The back frame 6 has a connecting portion 60. An end of the connecting portion 60 is connected to the base frame 5. A support 61 substantially perpendicularly extends from the connecting portion 60 toward the back 3. An arc-shaped bend portion 62 is formed between the support 61 and the connecting portion 60. The support 61 is provided with two symmetric positioning plates 610. Each positioning plate 610 has a positioning hole 611 for connecting the back 3. Additionally, the connecting portion 60 is formed with two trenches 601 for connecting the connecting section 52 of the base frame 5.

The back 3 is formed with two positioning recesses 30 corresponding to the positioning plates 610 in position and shape. Two fixing holes 31 are formed in the positioning recesses 30 for corresponding to the positioning holes 611. When the positioning plates 610 have been embedded into the positioning recesses 30, insert fasteners in the positioning holes 611 and fixing holes 31 to fasten the support 61 to the back 3. Preferably, the back is formed with a hollow portion 32 for reducing the structural strength of the back to be more easily bent. The top of the support 61 may be provided with a pad 33 in the hollow portion 32 for supporting the waist of a user.

When assembling, the shaft 201 is inserted into the shaft hole 510 to make the base frame 5 rotatable against the chassis 20. Next, the positioning plates 610 are embedded in the positioning recesses 30 and fasteners are used to pass the positioning holes 611 and fixing holes 31 to fasten them so that the back is fixed on the support 61. Finally, the trenches 601 are engaged with the rails 520 of the connecting section 52 to fasten the back frame 6 to the base frame 5.

Figure 5:
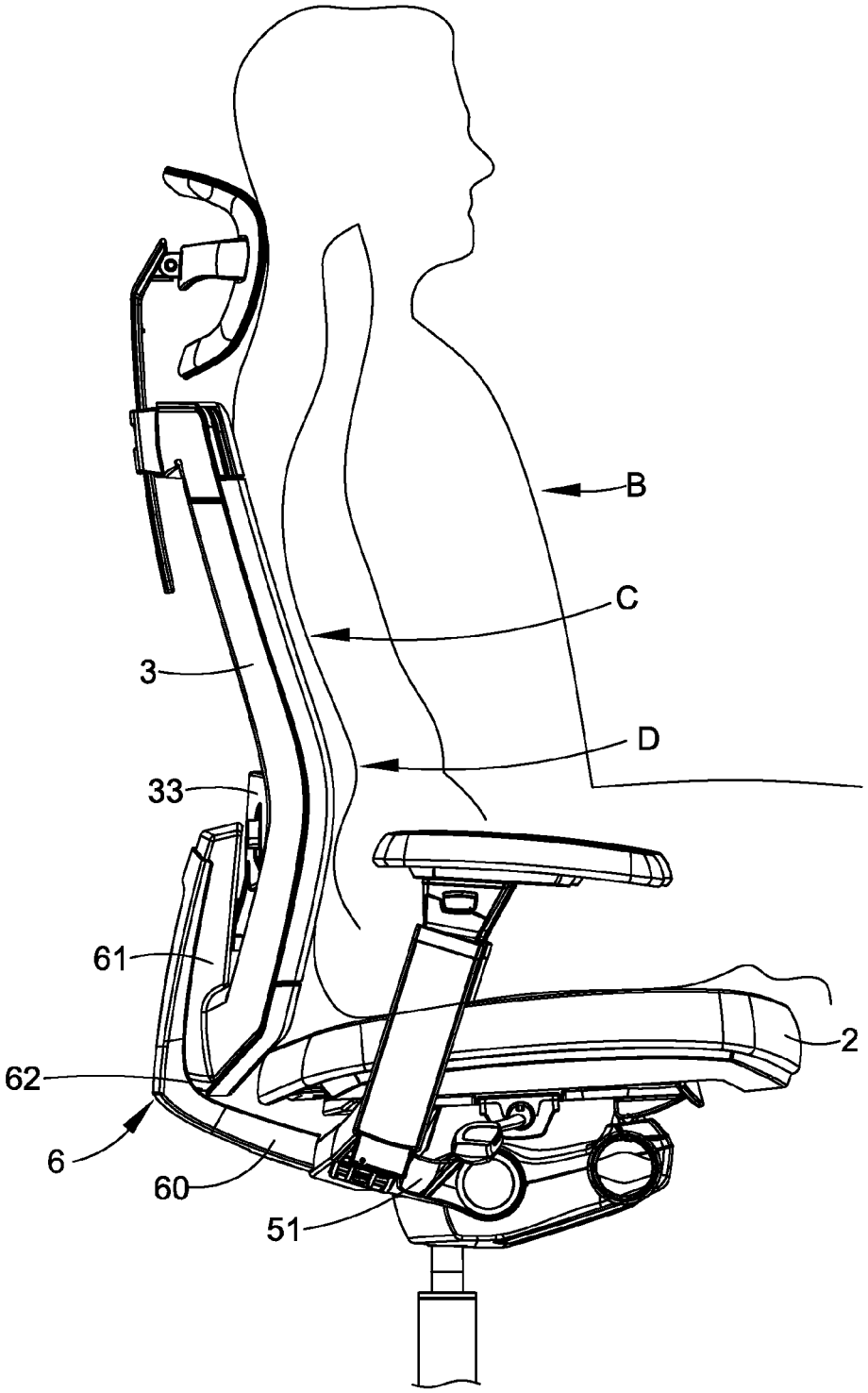
FIG. 5 is a schematic view of the invention without tilting the back.
Figure 6:
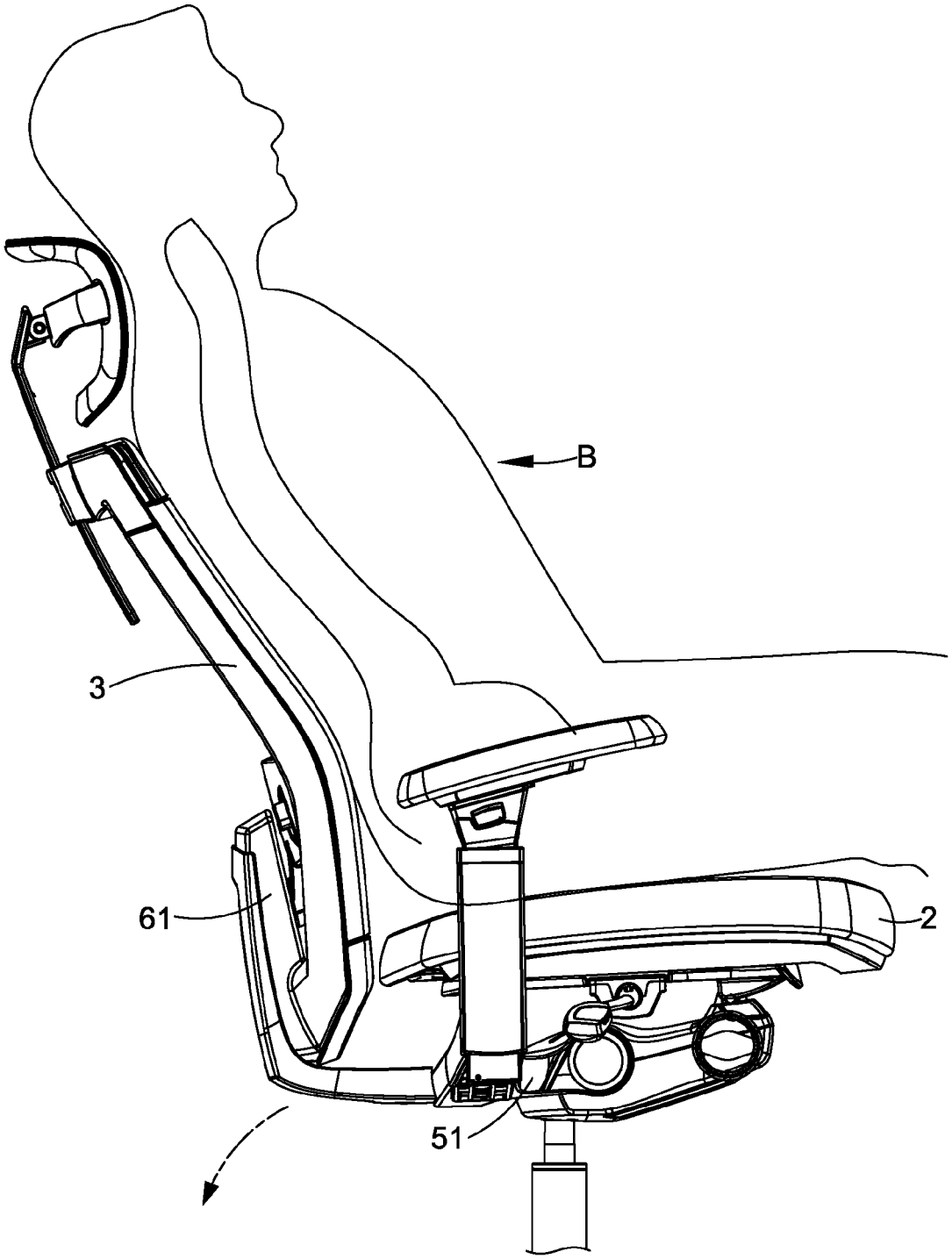
FIG. 6 is a schematic view of the invention without tilting the back.
Figure 7:
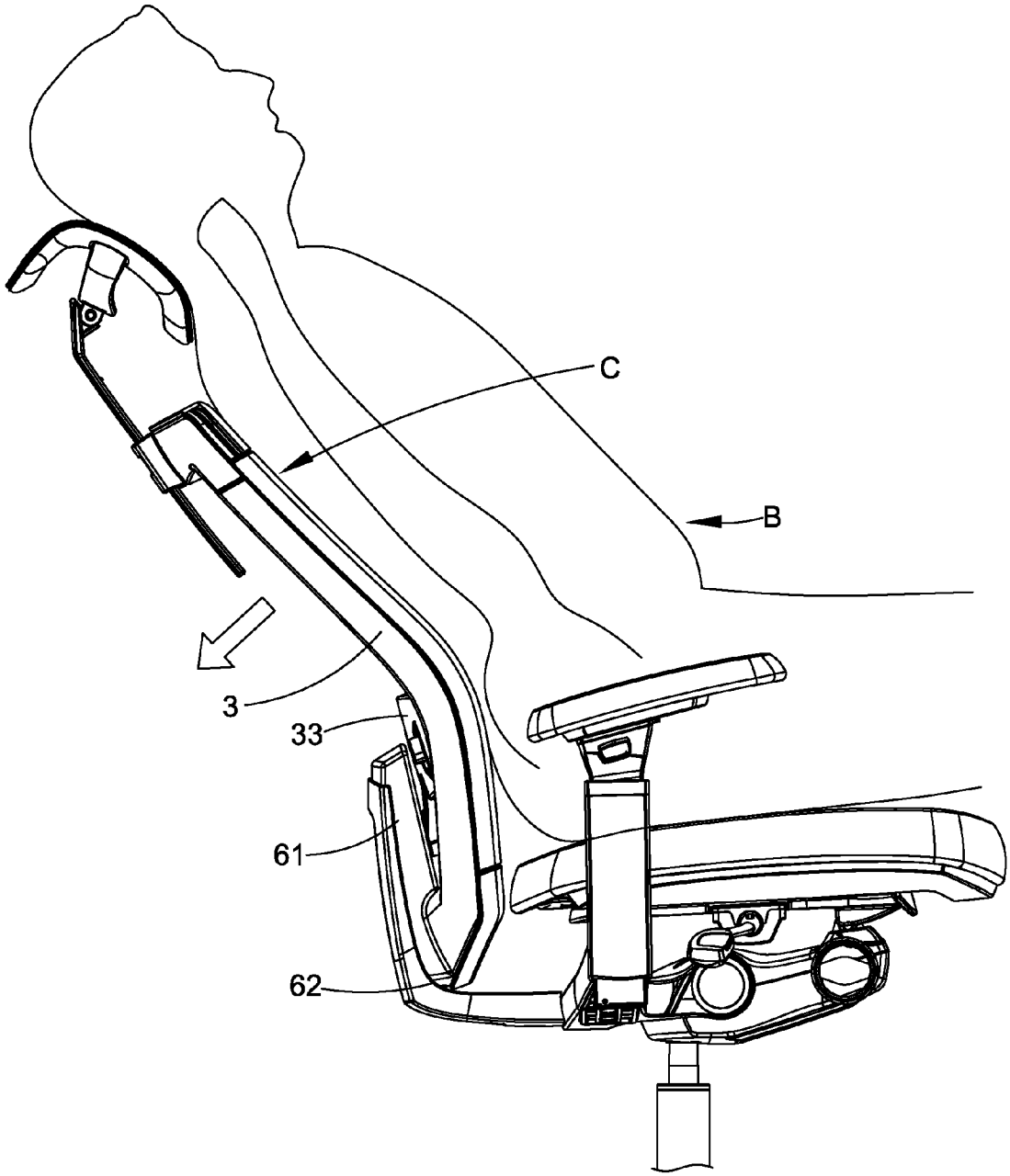
FIG. 7 is a schematic view of the invention with tilting and bending the back.

Please refer to FIGS. 5-7. When using, the back C of a user B leans against the chair back 3 and the waist D can be supported by the pad 33. When the user B leans back in the chair as shown in FIG. 6, the back frame 6 and the connecting arm 51 tilt rearward to a dead point. The user B may use his/her back C to further apply pressure to the chair back 3, the chair back 3 moves the support 61 to be bent rearward at the bend portion 62 as shown in FIG. 7.

It will be appreciated by persons skilled in the art that the above embodiment has been described by way of example only and not in any limitative sense, and that various alterations and modifications are possible without departure from the scope of the invention as defined by the appended claims.

What is claimed is:

1. A chair comprising:

a cushion, having a chassis;

a back, and an adjustment structure, connected to the chassis, comprising:

a base frame, having a main body with a connecting arm rotatably connecting the chassis; and a back frame, connected between the back and the base frame, having a connecting portion connected to the base frame and a support substantially perpendicularly extending from the connecting portion toward the back, an arc-shaped bend portion being formed between the support and the connecting portion, and a top of the support being connected to the back;

wherein the bend portion will further stretch to make the back tilt more when the back is pressed, the support is provided with two positioning plates, each positioning plate has a positioning hole, the connecting portion, the back is formed with two positioning recesses corresponding to the positioning plates in position and shape, two fixing holes are formed in the positioning recesses for corresponding to the positioning holes, and two fasteners are inserted into the positioning holes and the fixing holes to fasten the support to the back.

2. The chair of claim 1, wherein the back is formed with a hollow portion.

3. The chair of claim 2, wherein the support is provided with a pad in the hollow portion.

4. The chair of claim 1, wherein the base frame is provided with a connecting section, the connecting section is formed with a rail, and the connecting portion is formed with a trench for engaging with the rail.

5. The chair of claim 1, wherein the chassis is provided with a shaft, the connecting arm is formed with a shaft hole for rotatably receiving the shaft.

* * * * *